US009765931B2

(12) United States Patent
Beuneken et al.

(10) Patent No.: US 9,765,931 B2
(45) Date of Patent: Sep. 19, 2017

(54) METHOD AND DEVICE FOR FILLING A TANK WITH LIQUEFIED GAS

(71) Applicant: L'Air Liquide, Société Anonyme pour l'Etude et l'Exploitation des Procédés Georges Claude, Paris (FR)

(72) Inventors: Olivier Beuneken, Paris (FR); Fouad Ammouri, Massy (FR); Sitra Colom, Suresnes (FR); Marie Delclaud, Juvisy-sur-Orge (FR); Arthur Thomas, Noisy le Roi (FR); Olga Wojdas, Juvisy-sur-Orge (FR)

(73) Assignee: L'Air Liquide, Société Anonyme pour l'Etude et l'Exploitation des Procédés Georges Claude, Paris (FR)

( * ) Notice: Subject to any disclaimer, the term of this patent is extended or adjusted under 35 U.S.C. 154(b) by 71 days.

(21) Appl. No.: 14/646,073

(22) PCT Filed: Oct. 10, 2013

(86) PCT No.: PCT/FR2013/052414
§ 371 (c)(1),
(2) Date: May 20, 2015

(87) PCT Pub. No.: WO2014/080099
PCT Pub. Date: May 30, 2014

(65) Prior Publication Data

US 2015/0300570 A1 Oct. 22, 2015

(30) Foreign Application Priority Data

Nov. 23, 2012 (FR) ..... 12 61153

(51) Int. Cl.
*F17C 5/02* (2006.01)
*F17C 7/02* (2006.01)

(52) U.S. Cl.
CPC ..... *F17C 5/02* (2013.01); *F17C 7/02* (2013.01); *F17C 2223/0161* (2013.01);
(Continued)

(58) Field of Classification Search
CPC ..... F17C 5/02; F17C 7/02; F17C 2223/033; F17C 2223/0161; F17C 2223/035;
(Continued)

(56) References Cited

U.S. PATENT DOCUMENTS 5,411,374 A * 5/1995 Gram ..... F04B 15/06 141/18
5,477,690 A * 12/1995 Gram ..... F04B 15/06 62/45.1

(Continued)

FOREIGN PATENT DOCUMENTS

EP 1 291 575 3/2003
WO WO 2005 008121 4/2014

OTHER PUBLICATIONS

French Search Report and Written Opinion for corresponding FR 1261153, Jun. 18, 2013.

(Continued)

*Primary Examiner* — Nicolas A Arnett
(74) *Attorney, Agent, or Firm* — Elwood L. Haynes

(57) ABSTRACT

A method for filling a tank (1) with liquefied gas, in particular a tank with cryogenic liquid, from a liquefied gas container (2), in particular a cryogenic liquid container (2), wherein, following a predetermined time after filling has started, the method comprises the step of comparing the first instantaneous pressure (PT3) in the filling pipe (3) or an average of said first instantaneous pressure (PT3) with a predetermined maximum threshold (Pmax), and, when said first instantaneous pressure (PT3) in the filling pipe (3) or the average of said first instantaneous pressure (PT3), respec- (Continued)

tively, exceeds the maximum threshold (Pmax), the step of interrupting (AR) the filling (R).

15 Claims, 7 Drawing Sheets

(52) U.S. Cl.
CPC .. *F17C 2223/033* (2013.01); *F17C 2223/035* (2013.01); *F17C 2223/046* (2013.01); *F17C 2225/0161* (2013.01); *F17C 2225/035* (2013.01); *F17C 2227/0107* (2013.01); *F17C 2227/0135* (2013.01); *F17C 2227/044* (2013.01); *F17C 2250/032* (2013.01); *F17C 2250/043* (2013.01); *F17C 2250/0439* (2013.01); *F17C 2250/0443* (2013.01); *F17C 2250/0491* (2013.01); *F17C 2250/0636* (2013.01); *F17C 2260/021* (2013.01); *F17C 2260/025* (2013.01); *F17C 2265/063* (2013.01); *F17C 2270/0139* (2013.01); *F17C 2270/0171* (2013.01)

(58) Field of Classification Search
CPC ..... F17C 2223/046; F17C 2260/021; F17C 2260/025; F17C 2265/063; F17C 2270/0139; F17C 2270/0171; F17C 2250/0443; F17C 2250/0636; F17C 2250/0439; F17C 2250/032; F17C 2250/043; F17C 2250/0491; F17C 2225/0161; F17C 2225/035; F17C 2227/0107; F17C 2227/0135; F17C 2227/044
USPC ..... 141/1, 94–96; 62/50.1–50.7
See application file for complete search history.

(56) References Cited

U.S. PATENT DOCUMENTS

| | | | | |
|---|---|---|---|---|
| 5,551,488 | A * | 9/1996 | Gram | F04B 15/06 137/575 |
| 6,212,719 | B1 | 4/2001 | Thomas et al. | |
| 7,293,418 | B2 * | 11/2007 | Noble et al. | F17C 3/08 62/50.1 |
| 8,370,088 | B2 * | 2/2013 | Ammouri et al. | F17C 13/021 702/156 |
| 8,762,079 | B2 * | 6/2014 | Ammouri et al. | F17C 13/021 702/179 |
| 2006/0130925 | A1 | 6/2006 | Bourgeois et al. | |
| 2010/0241371 | A1 * | 9/2010 | Ammouri et al. | F17C 13/021 702/55 |
| 2010/0250157 | A1 * | 9/2010 | Ammouri et al. | F17C 13/021 702/55 |
| 2015/0330571 | A1 * | 11/2015 | Beuneken et al. | F17C 5/02 141/4 |
| 2015/0345704 | A1 * | 12/2015 | Beuneken et al. | F17C 5/02 141/4 |

OTHER PUBLICATIONS

International Search Report and Written Opinion for corresponding PCT/FR2013/052414, Apr. 4, 2014.

* cited by examiner

METHOD AND DEVICE FOR FILLING A TANK WITH LIQUEFIED GAS

CROSS REFERENCE TO RELATED APPLICATIONS

This application is a 371 of International PCT Application PCT/FR2013/052414 filed Oct. 10, 2013 which claims priority to French Patent Application No. FR 1261153 filed Nov. 23, 2012, the entire contents of which are incorporated herein by reference.

BACKGROUND

The present invention relates to a filling method and device.

The invention relates more particularly to a method for filling a liquefied gas tank, notably a cryogenic liquid tank, from a liquefied gas reservoir, notably a cryogenic liquid reservoir, the reservoir being fluidically connected to the tank via a filling pipe, the method using a pressure differential generating member for selectively transferring liquid from the reservoir to the tank, the pressure differential generating member being switchable to an on state or an off state, the filling pipe comprising a liquid flow regulating member positioned downstream of the differential generating member, the flow regulating member being movable between a no-flow position in which the flow of liquid is interrupted and at least one flow position in which the flow of liquid is transferred to the tank at a determined flow rate, the method comprising a step of starting the filling, during which step the flow regulating member is moved from the no-flow position to a flow position and a measurement of a first instantaneous pressure in the filling pipe downstream of the flow regulating member.

More generally, the invention may be applied to the filling of any cryogenic container (mobile or otherwise) from any other cryogenic container (mobile or otherwise).

The increasing demand from users for higher-pressure cryogenic liquid stores or reservoirs has led to the systems that fill these reservoirs being equipped with high-pressure pumps, which means to say pumps operating at pressures of between 24 bar and 40 bar. These same filling systems equipped with high-pressure pumps are called upon to fill low-pressure stores rated for pressures of 2 to 15 bar.

It is therefore necessary to fit the receiving reservoir and/or the filling device with a safety system that prevents the tank from being overfilled or over pressurized which would cause this tank to burst. Because the number of tanks to be filled is markedly higher than the number of filling devices, the safety system preferably applies to the filling devices.

There are various safety systems in existence for avoiding such phenomena.

Thus, one known solution is to equip the filling port of the tank with a pneumatic valve which closes when the pressure in the tank reaches a determined threshold. This solution does, however, have disadvantages which include the need to plan maintenance for this pneumatic valve and a high cost of installing it on all the tanks that require protection.

Another known solution is to provide a calibrated orifice at the tank filling port in order to keep the filling flow rate within safe ranges, typically to a flow rate that the existing safety members of the store can discharge. This solution is also installed on the tanks and penalizes filling time.

Another solution uses a rupture disk or a safety valve on the tank. This type of equipment has to be rated with care.

However, this rating may be incompatible with the internal pipes of the tank. In addition, if activated, expelled liquid has to be dealt with in an area that presents no risk to the operators. Finally, rupture disks may be subject to corrosion or mechanical fatigue requiring them to be replaced by a qualified technician.

Another solution is to provide an electric overpressure detection system on the tank (if appropriate via a thermistor at the overflow gauge valve) which, in response, stops the filling pump. However, this solution requires special connectors between each tank and each filling device and, where appropriate, relies on action on the part of the operator.

Another solution (cf. for example WO2005008121A1) consists in measuring the pressure at the tank via a safety hose provided for this purpose so as to stop the pump if a problem occurs. However, this solution requires an additional hose connection and suitable circuitry on the tank.

Another solution detects any potential over consumption of the pump and if appropriate switches it off. However, this solution can be applied only to variable-speed electric pumps and unwanted stoppages may be generated.

Another solution is to provide specific fluidic connections between filling devices and tanks according to determined pressure ranges. This solution imposes obvious constraints in terms of logistics in particular.

The document U.S. Pat. No. 6,212,719 describes a system for automatically stopping a filling pump if the supply hose ruptures using two pressure sensors arranged at the two ends of the transfer hose. Detection of a fall in pressure triggers the stopping of the pump.

SUMMARY

One object of the present invention is to alleviate all or some of the abovementioned disadvantages of the prior art.

To this end, the method according to the invention, which in other respects is in accordance with the generic definition thereof given in the above preamble, is essentially characterized in that, after a determined duration following the starting of the filling, the method comprises comparing the first instantaneous pressure in the filling pipe, or a mean of this first instantaneous pressure, against a determined high threshold and, when the first instantaneous pressure in the filling pipe or, as the case may be, the mean of the first instantaneous pressure exceeds the high threshold, a step of interrupting the filling.

Moreover, some embodiments of the invention may comprise one or more of the following features:

the flow regulating member comprises or consists of a valve, for example a valve with variable opening, the first pressure in the filling pipe is measured when the latter is in communication with the inside of the tank, namely when the filling pipe allows flow between the first pressure measurement point and the inside of the tank, during or after the starting of the filling, the method comprises determining a first reference instantaneous pressure (PT3ref) or a mean of reference instantaneous pressures (mPT3ref) in the filling pipe, and in that the high threshold (Pmax) is defined by the sum of, on the one hand, the first reference instantaneous pressure (PT3ref) or, as the case may be, of the mean of reference instantaneous pressures (mPT3ref) and, on the other hand, of a determined pressure jump (Po) (Pmax=PT3ref+Po or, as the case may be, Pmax=mPT3ref+Po), the determining of the first reference instantaneous pressure (PT3ref) or, as the case may be, the mean reference instantaneous pressure (mPT3ref) in the filling pipe is performed at least a first time via a measurement of the first instantaneous pressure (PT3) in the pipe or, as the case may be, of a mean (mPT3) of several measurements of this first instantaneous pressure (PT3) in a determined time interval of between zero and 180 seconds around at least one of the following events: the switching of the differential generating member from the off state (AR) to the on state (M), the start of a transfer of fluid from the reservoir to the tank, after the first reference instantaneous pressure (PT3ref) or, as the case may be, the mean reference instantaneous pressure (mPT3ref) has been determined and, during filling, the first instantaneous pressure (PT3) in the pipe is measured regularly and, if the first instantaneous pressure (PT3) measured in the pipe or, as the case may be, the mean thereof drops below the first reference instantaneous pressure (PT3ref) previously adopted or, as the case may be, the reference mean (mPT3ref) thereof, a new reference instantaneous pressure (PT3refb) or, as the case may be, a new reference mean (mPT3*b*) is determined and used to define a new high threshold (Pmax=PT3refb+Po, or, as the case may be, Pmax=mPT3refb+Po), a new high threshold (Pmax) is calculated upon each measured drop of the first instantaneous pressure (PT3) below the current first reference instantaneous pressure (PT3ref) previously adopted, as the case may be, upon each measured drop in the reference mean (mPT3) below the current reference mean (mPT3ref) previously adopted, the step of determining the first reference instantaneous pressure (PT3ref) in the filling pipe comprises at least one measurement of the first instantaneous pressure (PT3) in the pipe in a time interval of between zero and 180 seconds after a switching on (M) of the pressure differential generating member or in a determined time interval of between zero and 180 seconds after the starting of the actual transfer of a flow of liquid to the tank, the first reference instantaneous pressure (PT3ref) being the value measured during the at least one pressure measurement or a mean of this at least one pressure measurement, the step of interrupting the filling comprises at least one of the following: reducing or stopping the circulation of liquid in the filling pipe, stopping the pressure differential generating member, a purging of at least part of the filling pipe to a discharge zone distinct from the tank, activation of a bypass returning the liquid circulating in the filling pipe to the reservoir, the emission of a visual and/or audible alarm, the pressure differential generating member comprises at least one of the following: a pump, a vaporizer for selectively pressurizing the reservoir, is selectively switchable between an on state and an off state, the method comprising a switching on of the pressure differential generating member and in that the pressure differential generating member is switched to its off state automatically in response to at least one of the following situations:

the variation in the first instantaneous pressure (PT3) in the filling pipe during a determined time before a flow of liquid is actually transferred to the tank is greater than a determined variation (V) (ΔPT3>V), a determined variation in flow rate (Q) and/or a determined variation in a second instantaneous pressure (PT2) in the pipe T(3) downstream of the pressure differential generating member is detected while the pressure differential generating member is not in the switched-on state (M), after a determined time following the switching on of the pressure differential generating member, the variation in the first instantaneous pressure (PT3) in the pipe and/or the variation in flow rate (Q) remains below a determined level, after a determined time following the switching on of the pressure differential generating member or the start of transfer of a flow to the tank, or even after a determined quantity of fluid has been transferred to the tank, the first instantaneous pressure (PT3) in the pipe remains above a determined high level, after a determined time following the switching on of the pressure differential generating member or the start of transfer of a flow to the tank, or even after a determined quantity of fluid has been transferred to the tank, the differential (PT2−PT3) between, on the one hand, a second instantaneous pressure (PT2) measured at the outlet of the pressure differential generating member, upstream of the flow regulating member, and, on the other hand, the first instantaneous pressure (PT3) measured in the pipe downstream of the flow regulating member is less than a minimum differential preferably between 0.5 bar and 2 bar, a fall in the first pressure (PT3) of at least one bar per second is measured, notably corresponding to a rupture of the filling pipe the method comprises a switching on (M) of the pressure differential generating member, the step of interrupting (AR) the filling when the first instantaneous pressure (PT3) or, as the case may be, the mean instantaneous pressure (mPT3) in the filling pipe exceeds the high threshold (Pmax) being performed only at the end of a timing step (A) notably designed to allow the conditions in which liquid is transferred to the tank to stabilize, the timing step (A) beginning with the switching on of the pressure differential generating member or with the transition of the regulating member to the flow position and having a determined finite duration, during or before the determined duration following the starting of the transfer of a flow of liquid to the tank, any potential variations in the first instantaneous pressure (PT3) measured in the filling pipe or variations in the mean of these measurements above the high threshold (Pmax) do not trigger the stopping of the filling, after the pressure differential generating member has been switched on (M) and the flow regulating member has been moved from its no-flow position into its flow position, if a drop in the first instantaneous pressure (PT3) in the filling pipe at a rate of at least one bar per second is detected, the operation of the pressure differential generating member is automatically switched off, at the start of filling the method comprises measuring the so-called "reference" value of the first instantaneous pressure (PT3ref) or of a reference mean of the instantaneous pressure (mPT3ref) in the filling pipe, and when the reference instantaneous pressure (PT3ref) or the reference mean instantaneous pressure (mPT3ref) is higher than a predetermined low value and lower than a predetermined high value, the high threshold (Pmax) is less than or equal to twice and preferably less than one and a half times the value of the first reference instantaneous pressure (PT3ref) or, as the case may be, the mean reference instantaneous pressure (mPT3ref) (Pmax≤2PT3ref, and preferably Pmax≤1.5PT3ref or, as the case may be, Pmax≤2mPT3ref and preferably Pmax≤1.5mPT3ref), the predetermined low value preferably being comprised between three and five bar, the predetermined high value preferably being comprised between nineteen and twenty-five bar, the pressure differential generating member comprises at least one of the following: a pump, a heater, a vaporizer, the start of filling corresponds to at least one of the following: the switching on of the pressure differential generating member, the start of actual transfer of fluid from the reservoir (2) to the tank, the filling pipe comprises, in series, from upstream to downstream, the pressure differential generating member, a second pressure sensor, the regulating member that regulates the flow of liquid in the filling pipe, and the first pressure sensor, the filling pipe further comprises a fluid flow rate measuring member situated between the first and second pressure sensors, the duration of the timing step is between five and one hundred and forty-five seconds and preferably between ten and one hundred and twenty seconds and more preferably still, between thirty and ninety seconds, the switching on of the pressure differential generating member comprises a check of the flow rate of liquid delivered by the pressure differential generating member in order to keep the instantaneous liquid flow rate in the filling pipe downstream of the pressure differential generating member above a determined minimum flow rate, at least during filling, the first instantaneous pressure (PT3) in the filling pipe is kept above a determined minimum pressure threshold (PT3min), the method comprises, during or before the step of starting filling, a step of determining the pressure (PT4) in the tank by measuring the first pressure (PT3=PT4) at the filling pipe and a step of regulating the pressure in the filling pipe downstream of the pressure differential generating member to a determined value of between one times and four times, and preferably between one and a half times and three times the determined value for the pressure (PT4) in the tank, the method comprises, at the start of the filling, a step of comparing a mean of the first instantaneous pressure (PT3) in the filling pipe with the determined high threshold (Pmax) and, when the mean first instantaneous pressure (PT3) exceeds the high threshold, a step of automatically interrupting the filling, the mean of the first instantaneous pressure (PT3) being the mean of several values of the first instantaneous pressure (PT3) measured successively during a time interval of between 0.1 and 10 seconds and preferably between 0.25 seconds and 1 second, the method comprises, at the end of the timing step (A), a step of comparing a mean of the first instantaneous pressure (PT3) in the filling pipe against determined high threshold (Pmax) and, when the mean of the first instantaneous pressure (mPT3) exceeds the high threshold, a step of automatically interrupting the filling, the mean of the first instantaneous pressure (PT3) being the mean of several first instantaneous pressures (PT3) measured in succession over a time interval of between 0.1 and 10 seconds and preferably between 0.25 seconds and 1 second, the step of determining the reference instantaneous pressure (PT3ref) in the filling pipe comprises at least one measurement of the first instantaneous pressure (PT3) in the pipe in a time interval of between zero and ten seconds around the switching on of the pressure differential generating member or around the end of the timing step (A), the reference instantaneous pressure (PT3ref) in the filling pipe being the value measured during the at least one pressure measurement or a mean of this at least one pressure measurement, the value of the pressure jump is an adjustable or non-adjustable set value comprised between 0.1 bar and 2 bar and preferably between 0.3 and 1 bar and more preferably still between 0.4 and 0.6 bar, the step of measuring the first instantaneous pressure (PT3) in the filling pipe downstream of the pressure differential generating member is performed continuously or periodically, the value of the pressure jump is a function of the value of the first reference instantaneous pressure (PT3ref), when the first reference instantaneous pressure (PT3ref) is less than or equal to a value of between 6 to 9 bar, the pressure jump is between 0.1 and 0.9 bar and preferably between 0.3 and 0.7 bar, when the first reference instantaneous pressure (PT3ref) is higher than a determined value of between 6 and 9 bar and lower than a determined value of between 15 and 25 bar and preferably between 18 and 22 bar, the pressure jump is between 0.8 and 1.4 bar and preferably between 0.9 and 1.2 bar, when the first reference instantaneous pressure (PT3ref) is higher than a determined value of between 15 and 25 bar and preferably between 18 and 22 bar, the pressure jump is between 1.2 and 2 bar and preferably between 1.2 and 1.7 bar, the switching off of the pump is performed by switching the pump into a passive mode notably by switching off its drive motor and/or by closing at least one controlled valve, during the timing step, any potential variations in the first instantaneous pressure (PT3) which are measured in the filling pipe or the variations of the mean of these measured first instantaneous pressures (PT3) which are above the high threshold (Pmax) do not trigger the stopping of the filling, the pressure in the reservoir is kept above a determined value by drawing liquid from the reservoir, vaporizing this drawn-off liquid and reinjecting the vaporized liquid into the reservoir, during filling, the fluid pressure downstream of the pressure differential generating member is kept above the value of the pressure (PT4) in the tank, the fluid pressure in the filling pipe downstream of the pressure differential generating member is kept above the tank pressure value (PT4) by reducing/interrupting the direct return of fluid from the pressure differential generating member to the reservoir, the filling pipe comprises an upstream portion secured to the reservoir and a downstream portion, the downstream portion is preferably flexible and comprises a first end coupled in a disconnectable manner to the upstream portion and a downstream second end coupled in a disconnectable manner to a filling inlet of the tank, the flow regulating member comprises or consists of a valve with variable opening, the first instantaneous pressure (PT3) in the filling pipe downstream of the pressure differential generating member is measured via at least a first pressure sensor, the method is implemented by an installation comprising electronic logic receiving the measurements of the first instantaneous pressure (PT3) in the filling pipe, the electronic logic controlling the operation of the pressure differential generating member, the filling pipe is equipped with a variable-opening valve positioned downstream of the pressure differential generating member so as to regulate the flow rate of liquid delivered to the tank, said variable-opening valve preferably being of the one-way type, namely of the type that prevents reflux of fluid upstream toward the pressure differential generating member, during the timing step, the flow rate of fluid transferred to the tank is regulated via said variable-opening valve positioned downstream of the pressure differential generating member, after the step of interrupting the filling, the pressure differential generating member cannot be restarted until a determined waiting time preferably of between one second and fifteen minutes has elapsed, the pressure differential generating member is prevented from starting when the measurement of the first instantaneous pressure (PT3) in the filling pipe downstream of the pump is unavailable, at least one of the following steps is performed automatically or manually: the step of measuring the first instantaneous pressure (PT3) in the filling pipe downstream of the pressure differential generating member, the timing step (A), the step of comparing the first instantaneous pressure (PT3) in the filling pipe against a determined high pressure threshold (Pmax), the step of interrupting the filling, the check on the stability of the first pressure, the selective purging of at least part of the filling pipe to a discharge region distinct from the tank uses a discharge pipe comprising an end open to the atmosphere, said discharge pipe being fitted with a valve, said selective purging being performed for a determined purge duration of between two and sixty seconds and preferably of between five and thirty seconds, the bypass that selectively returns liquid leaving the pump to the reservoir comprises a pipe (8) fitted with at least one bypass valve, the step of interrupting the filling by activating the bypass returning liquid downstream of the pump to the reservoir comprises an opening of the at least one bypass valve for a determined duration preferably of between two and sixty seconds, the switching on of the pressure differential generating member can be performed only after a first positive check has been made on the stability of the first instantaneous pressure (PT3) in the filling pipe, the first check on the stability of the pressure being positive if the first pressure (PT3) is above atmospheric pressure and if at least one of the following conditions is satisfied:

(i) the first instantaneous pressure (PT3) in the pipe (3) is above a determined pressure of, for example, between 15 and 25 bar, (ii) the variation in the first instantaneous pressure (PT3) during at least a determined interval of time is below a determined level of variation corresponding for example to a variation of between 0.005 and 0.020 bar per second, at the time or after the switching on of the pressure differential generating member, the method comprises a step of determining the pressure (PT4) in the tank only by measuring the first pressure (PT3=PT4) at the filling pipe, the method comprising, after determining the pressure (PT4) in the tank, a step of limiting the first instantaneous pressure (PT3) to below a maximum pressure threshold (PT3sup), the maximum pressure threshold being defined as a function of the determined value of the pressure (PT4) in the tank (1) and exceeding the determined value of the pressure (PT4) in the tank by 2 to 20 bar and preferably by 2 to 9 bar, the pressure (PT4) in the tank is determined and the step of limiting the first instantaneous pressure (PT3) to below a maximum pressure threshold (PT3sup) is achieved while the flow regulating member (12) is in the flow position, when the determined value for the pressure (PT4) in the tank is less than or equal to a first determined level of between three and five bar, the maximum pressure threshold is a predetermined set pressure value of between 5 and 9 bar and preferably equal comprised between 5.2 and 7 bar, the step of limiting the first instantaneous pressure (PT3) to below a maximum pressure threshold (PT3sup) comprises at least one of the following: manual or automatic regulation of the flow rate of transferred fluid using the flow regulating member, manual or automatic regulation of the pressure differential generated by the pressure differential generating member, the step of limiting the first instantaneous pressure (PT3) to below the maximum pressure threshold (PT3sup) is performed during a finite determined limiting duration and in that, when the first instantaneous pressure (PT3) remains higher than the maximum pressure threshold (PT3sup) at the end of the determined limiting duration, filling is automatically interrupted (AR), the determined limiting duration is between fifteen and two hundred seconds and preferably between thirty and one hundred and eighty seconds and, for example, between fifteen and sixty seconds or for example equal to ninety seconds, during the step of limiting the first instantaneous pressure (PT3), the method comprises a measurement of the quantity (Q) of fluid transferred from the reservoir (2) to the tank (1) and in that, when this transferred quantity of fluid (Q) exceeds a threshold quantity (Qs) before the end of the determined limiting duration, said limiting duration initially set is reduced.

The invention also relates to a device for filling a liquefied gas tank, comprising a cryogenic liquid reservoir, the reservoir being selectively fluidically connected to the tank via a filling pipe having an upstream first end connected to the reservoir and a downstream second end that can be selectively coupled to a tank, the device comprising a pressure differential generating member for transferring liquid from the reservoir to the tank via a filling pipe, a regulating member regulating the flow of liquid in the filling pipe, the flow regulating member being movable between a no-flow position in which the flow of liquid is interrupted and at least one flow position in which the flow of liquid is transferred to the tank at a determined respective flow rate, the device further comprising a first pressure sensor positioned on the filling pipe downstream of the flow regulating member, and electronic logic connected to the pressure differential generating member, to the first pressure sensor and to at least one member for selectively limiting or interrupting the filling, the electronic logic being configured in order to make, during the filling, after a determined time following the start of transfer of a flow of liquid to the tank, a comparison between the first instantaneous pressure or a mean of this first instantaneous pressure (PT3) and a determined high threshold (Pmax) and, when the first instantaneous pressure (PT3) or, as the case may be, the mean of the first instantaneous pressures (PT3) in the filling pipe exceeds the high threshold (Pmax), to interrupt (AR) the filling via the at least one limiting or interrupting member.

According to other possible specifics:

the at least one limiting or interrupting member comprises at least one of the following:

a switch or actuator commanding the switching off of the pressure differential generating member, a purge pipe provided with a valve that is controlled and connected to the electronic logic, the purge pipe comprising a first end coupled to the filling pipe and a second end opening into a discharge zone distinct from the tank, a bypass pipe provided with a valve that is controlled and connected to the electronic logic, the bypass pipe comprising a first end coupled to the filling pipe and a second end opening into the reservoir, a controlled isolation valve connected to the electronic logic.

The invention may also relate to any alternative device or method comprising any combination of the features above or below.

BRIEF DESCRIPTION OF THE DRAWINGS

Other specifics and advantages will become apparent from reading the following description given with reference to the figures in which:

FIGS. 1 to 9 in simplified fashion illustrate one example of a filling installation that can be used according to the invention.

DESCRIPTION OF PREFERRED EMBODIMENTS

Figure 1:
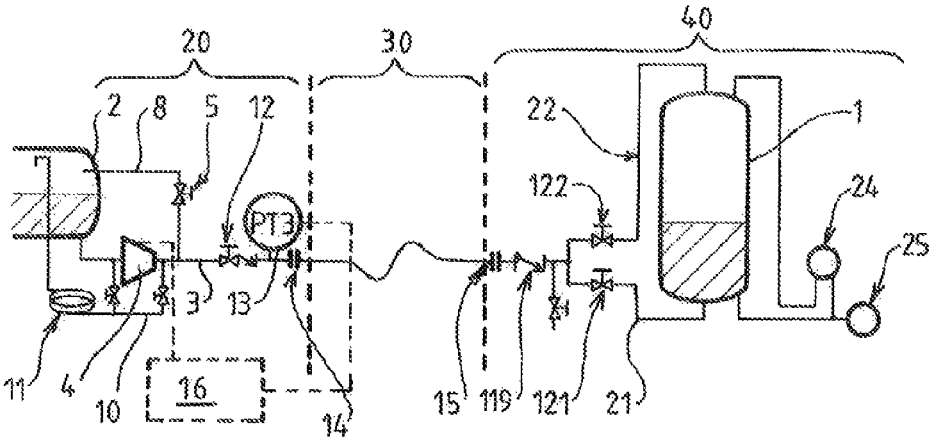
FIG. 1 is a schematic and partial view illustrating a first example of a structure and operation of a device for filling a tank according to the invention.

The filling device comprises a cryogenic liquid reservoir 2. This reservoir 2 is, for example, a double-walled reservoir the space between the walls of which is insulated by a vacuum. The reservoir 2 is, for example, mobile and transportable, if appropriate on a delivery truck such as a semi-trailer.

The reservoir 2 contains liquefied gas and may be selectively fluidically connected to a tank 1 to be filled via a filling pipe 3.

The filling pipe 3 comprises an upstream end connected to the storage volume of the reservoir 2 and a downstream end that can be selectively coupled to the tank 1. The filling pipe 3 is fitted with a member 4 for generating a pressure differential in the fluid and, downstream of this member, with a valve 12 having variable opening. For example, the pressure differential generating member 4 is a pump. Of course the invention is not in any way restricted to this embodiment. Thus, the pressure differential generating member may in the conventional way comprise a vaporizer and/or a heater associated with at least one valve that allows the pressure in the reservoir 2 to be raised so that it can be transferred to a tank. Any other pressure differential generating member that allows fluid to be made to transfer from the reservoir 2 to the tank 1 may equally be used.

For preference, the pressure differential generating member 4 may be controlled in such a way as to vary its power, namely to increase or decrease the level of pressure differential generated (for example by controlling the power of the pump or the rise of pressure inside the reservoir 2).

The variable-opening valve 12 is preferably a manually actuated valve (although this is not in any way limiting).

The device further comprises a first pressure sensor 13 positioned on the filling pipe 3 downstream of the variable-opening valve 12.

When the filling pipe 3 is in fluidic communication with the inside of the tank 1, namely when the pipe allows flow at least between the pressure sensor 13 and the inside of the tank 1, the sensor 13 measures a pressure indicative of the pressure PT4 in the tank 1.

Figure 13:
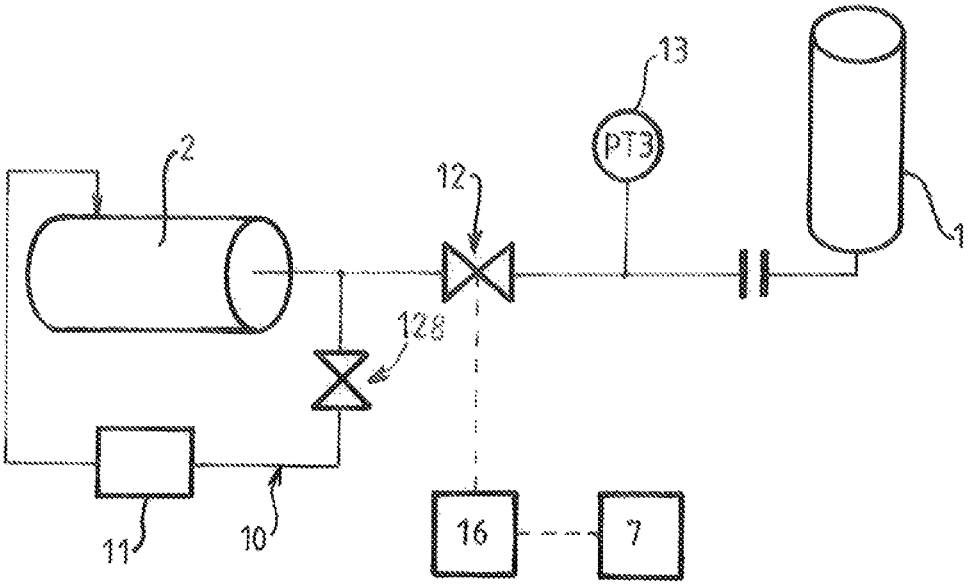
FIG. 13 is a schematic, simplified and partial view similar to FIGS. 3 to 8 illustrating yet another possible embodiment of the structure and operation of a filling device according to the invention.

The device further comprises electronic logic 16 connected to the pump 4 and to the pressure sensor 13. The electronic logic 16 comprises for example a microprocessor and an associated memory. In instances in which the device does not comprise a pump, the electronic logic 16 may be connected to at least one controlled valve 128, 12 situated on the filling pipe 3. As illustrated notably in the example of FIG. 13, the pressure differential generating member comprises a vaporizer 11 situated in a pressurizing pipe 10 associated with a valve 128 so as to allow the pressure in the reservoir 2 to be increased. The increase in pressure is achieved by withdrawing liquid from the reservoir 2, vaporizing it and reintroducing it into the reservoir 2. This rise in pressure in the reservoir generates a pressure differential that allows a flow of liquid to be created in the filling pipe 3. Actual filling and the stopping of filling may be defined by whether a valve 12 on the filling pipe 3 is in the flow or no-flow position.

The electronic logic 16 is configured to command or detect a switching on M or a switching off AR of the pressure differential generating member 4. In the case of a pump 4, the on state M or off state AR may respectively correspond to the on state or off state of its drive motor. In the case of a vaporizer system intended to increase the pressure in the reservoir 2, the on and off state may correspond to the open/closed state of at least one valve or to whether or not the reservoir 2 is actually pressurized. The description which follows covers the case of a pump but can be applied by analogy to the case of some other pressure differential generating member.

In particular, the electronic logic 16 controls the switching on M of the pump 4 (cf. step 100, FIG. 10) and may trigger an optional timed period A in order notably to allow the conditions under which liquid is transferred to the tank 1 to stabilize. In one possible alternative form, the control logic 16 receives as input parameter information concerning the switching on M of the pump and/or information concerning the opening of at least one controlled valve 12, 128.

Figure 10:
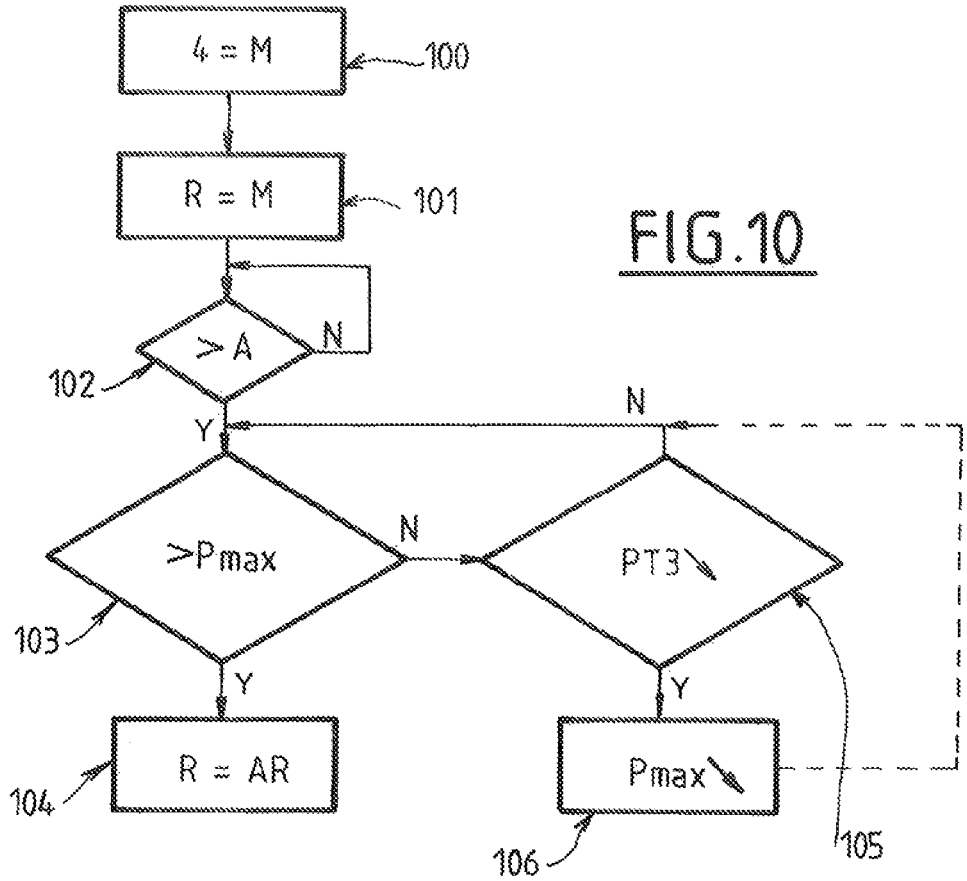
FIG. 10 illustrates a first possible example of a succession of steps performed during a filling according to one embodiment of the invention.

After the conditions for transferring liquid to the tank 1 have stabilized, actual filling R of the tank 1 can begin (cf. reference 101 R=M, FIG. 10).

The timing step A (cf. 102, FIG. 10) preferably begins when the pump 4 is switched on and has a finite duration.

After the timing step A, the electronic logic 16 may be configured to interrupt AR the filling R automatically as soon as the first instantaneous pressure PT3 measured in the filling pipe 3 during filling exceeds a predetermined high threshold Pmax (cf. references 103 "Y" and 104, FIG. 10).

By contrast, during the timing step A, the variations in the first pressure PT3 in the filling pipe 3 above the high threshold Pmax do not interrupt filling (reference 102, FIG. 10).

This configuration makes it possible effectively and sufficiently early on to detect an overflow at the tank 1 which could lead to an overpressure in the tank 1 during filling without the need for costly auxiliary detection or communication systems. Indeed the inventors have noticed that this configuration additionally makes it possible to avoid spurious overfill detections. In addition, the operator is not bound to perform additional operations during filling. This configuration further contributes to stabilizing the conditions of filling of the tank. This makes it possible to increase the life of the equipment by reducing detrimental pressure variations.

Instead of interrupting filling when the first instantaneous pressure PT3 exceeds the high threshold Pmax, as an alternative (or in combination), the electronic logic 16 may be configured to check a mean of first instantaneous pressures PT3max measured in the filling pipe 3. What that means to say is that the device commands the stopping of the filling as soon as this mean of first pressures PT3 exceeds a predetermined high threshold Pmax.

Figure 9:
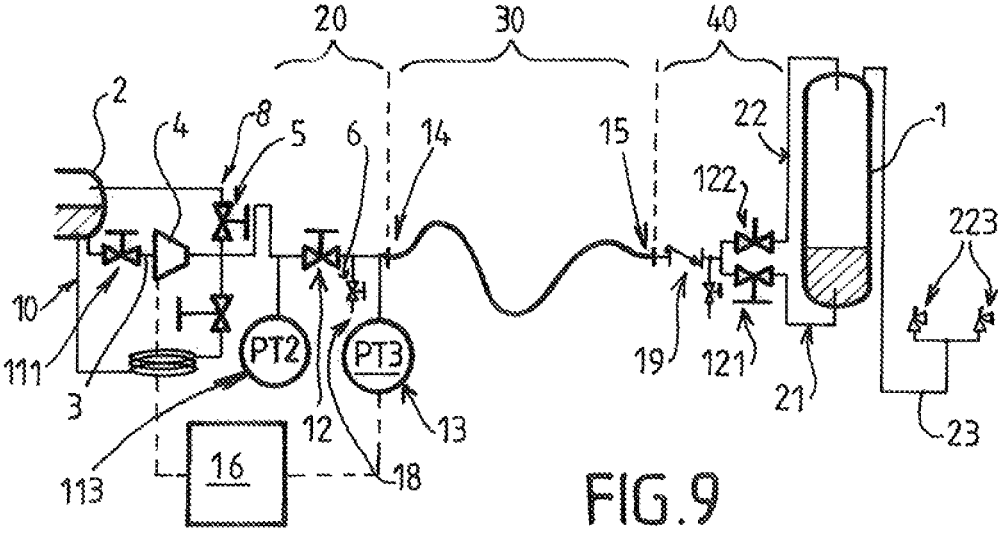
FIG. 9 is a schematic and partial view illustrating yet another example of a structure and operation of a filling device according to the invention.

As illustrated in FIGS. 1 and 9, the filling device preferably comprises a return (or bypass) pipe 8 fitted with a bypass valve 5. The bypass pipe 8 comprises a first end coupled to the filling pipe 3 downstream of the pump 4 and a second end opening into the reservoir 2 in order selectively to return pumped liquid.

Figure 2:
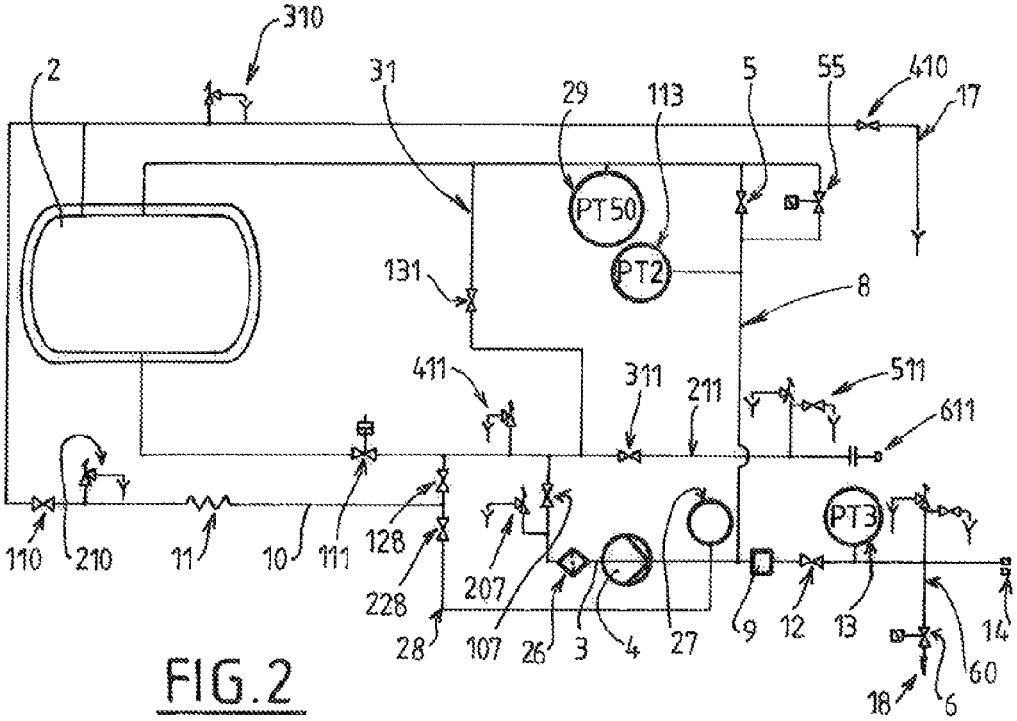
FIG. 2 is a schematic and partial view illustrating a second example of a structure and operation of a filling device according to the invention.

As illustrated also, the filling device may comprise a pressurizing pump 10 for selectively pressurizing the reservoir 2. The pressurizing pipe 10 may comprise two first ends which are connected to the filling pipe 3 respectively upstream and downstream of the pump 4 (cf.; FIGS. 1 and 2). The pressurizing pipe 10 comprises a second end connected to the storage volume of the reservoir 2. The pressurizing pipe 10 comprises a heat exchanger 11 for selectively vaporizing the pumped liquid before it is reintroduced into the reservoir 2.

As illustrated in FIG. 1, the filling pipe 3 may comprise an upstream portion 20 secured to the reservoir 2 and a downstream portion 30. The downstream portion 30 is preferably flexible and comprises a first end 14 coupled in a disconnectable fashion to the upstream portion 20 and a downstream second end 15 coupled in a disconnectable manner to a filling inlet of the tank 1. The circuitry downstream 40 of the second end 15 of the downstream portion 30 may comprise a nonreturn valve 119 preventing the reflux of fluid from the tank 1 to the filling pipe 3. The circuitry 40 may next comprise two pipes 21, 22 coupled respectively to the bottom and top parts of the tank 1 via respective valves 121, 122. The tank 1 is, for example, a cryogenic tank insulated under a vacuum.

As illustrated in FIG. 1, the tank 1 further and preferably comprises a system for measuring pressure in the bottom part 25 and a system for measuring the pressure 24 at the top (or a system for measuring a pressure differential between the top and bottom parts of the tank 1).

FIG. 2 illustrates a more detailed further example of a design of filling device correspondingly notably to the upstream part 20 of the filling pipe of FIG. 1.

The filling pipe 3 is connected to the bottom part of the reservoir 2 and may comprise, from upstream to downstream (namely from the reservoir 2 toward the end that can be coupled to a hose), a first 111 and a second 107 valve, which valves are arranged in series upstream of the pump 4. As depicted, a safety valve 207 and a filter 26 may be positioned upstream of the pump 4. Downstream of the pump 4, the filling pipe 3 comprises the variable-opening valve 12.

As depicted, between the pump 4 and the variable-opening valve 12, the filling pipe 3 may comprise at least one of the following: a temperature sensor 27 and a flow rate measuring member 9 such as a flow meter. Downstream of the variable-opening valve 12 the pipe preferably comprises the first pressure sensor 13 mentioned hereinabove. The filling pipe 3 may also comprise, downstream of the first pressure sensor 13, a purge pipe 60 fitted with at least one controlled valve 6 allowing liquid to be discharged to a discharge zone 18.

A bypassing pipe 28 may be provided to allow the reservoir to be pressurized via the pump 4. This bypassing pipe 28 comprises an upstream end coupled downstream of the pump 4 and a downstream end coupled to the reservoir 2. The bypassing pipe 28 comprises, for example, two pump bypassing valves 128, 228 arranged in series. As in the example of FIGS. 1 and 9, the device comprises a pressurizing pipe 10 for the selective pressurizing of the reservoir 2. The pressurizing pipe 10 comprises a first end connected between the two pump bypassing valves 128, 228 and a downstream end connected to the reservoir 2.

As depicted, the downstream end of the pressurizing pipe 10 may also be connected to a discharge line 17 comprising a discharge valve 310 and a valve 410.

As previously, a bypass pipe 8 is provided for selectively sending the pumped liquid to the reservoir 2. The bypass pipe 8 has an upstream end connected to the filling pipe 3 downstream of the pump 4 (for example between the temperature sensor 27 and the optional flow meter 9). The bypass pipe 8 has a downstream end connected to the reservoir 2.

The bypass pipe 8 comprises at least one bypass valve 5 and, in the example depicted, two valves 5, 55 arranged in parallel, the valve 55 preferably being controlled.

The bypass pipe 8 may comprise a pressure sensor 113 sensing the pressure PT2 upstream of the bypass valves 5, 55. This sensor in fact measures a second pressure PT2 in the filling pipe 3 upstream of the variable-opening valve 12 and downstream of the pressure differential generating member 4. The bypass pipe 8 where appropriate comprises another pressure PT50 sensor 29 positioned downstream of the bypass valves 5, 55.

Downstream of the first valve 111, the circuit may comprise a pipe 211 for filling the reservoir 2 which is parallel to the filling pipe 3. This pipe 211 comprises, from upstream to downstream, a first safety valve 411, a valve 311, a second safety valve 511 and an end 611 that can be coupled to an application. This pipe 211 can be coupled to the bypass pipe 8, downstream of the bypass valves 5, 55 via a branch 31.

For preference, the operation of filling a tank 1 is at least partly manual and notably an operator can manually control the variable-opening valve 12. Of course, all or some of these actions can be automated, notably by using suitable controlled members (notably controlled valves).

For preference, in instances in which the device makes use of a pump 4, and without this however being limiting, the pump 4 is of the type that delivers a flow rate controlled by a frequency variator, notably a pump of the centrifugal type. Of course, any other type of pump is also appropriate.

Before beginning the filling, if the model of pump 4 requires it, the pump 4 is first of all cooled and stabilized for a determined interval of time. In order to do this, the operator may send the pumped liquid back to the reservoir 2 via the bypass pipe 8 (for example by opening the bypass valve 5 and keeping the variable-opening valve 12 closed).

Once the operating conditions of the pump 4 are stabilized in order to limit the intensity of the pump 4, for example in terms of the temperature of the pump 4 and/or pressure downstream of the pump 4 and/or in terms of the flow rate supplied by the pump 4, the operator can progressively close the bypass valve 5 again and begin the actual filling of the tank by opening the variable-opening valve 12 (examples of stabilized conditions of operation of the pump 4 will be described hereinafter).

During filling, the first instantaneous pressure PT3 on the filling line 3 is measured downstream of the variable-opening valve 12 using the first sensor 13.

The first pressure PT3 in the filling pipe 3 is preferably kept higher than the pressure in the tank 1 that is to be filled and the pressure in the reservoir 2 is also kept above a minimum value.

The variations in this first measured pressure PT3 mimic the variations in pressure in the tank 1 during the course of filling.

According to one advantageous specific already mentioned hereinabove, at the end of the timing step A, abnormal increases in this pressure PT3 are defined and, when detected, cause filling to stop automatically.

The examples described hereinafter and notably the numerical values are given by way of indication and may as appropriate be adapted notably according to the performance of the filling system and the types of tanks considered.

The timing step A has a duration for example of between five and one hundred and eighty seconds and preferably between ten and ninety seconds and, more preferably still, between thirty and sixty seconds. This duration of the timing step A is preferably chosen notably as a function of the technical characteristics of the pump 4 and of the procedures required for controlling it.

At the end of the timing step A, an abnormal increase in the first pressure PT3 may be detected by monitoring the first instantaneous pressure PT3.

Thus, for example, at the end of the timing step A the device may determine a first reference instantaneous pressure PT3ref in the pipe 3. The high threshold Pmax may be defined as being the sum of, on the one hand, the first reference instantaneous pressure PT3ref recorded and, on the other hand, a determined pressure jump Po. What that means to say is that the high threshold Pmax (in bar) which triggers the stopping of the filling is given by:

$$P\text{max}=PT3\text{ref}+Po.$$

The determining of the first reference instantaneous pressure PT3ref may comprise at least a measurement of the first instantaneous pressure PT3 in the pipe 3 in a time interval of between zero and ten seconds around the end of the timing step A. This first reference instantaneous pressure PT3ref may be a spot value, a maximum or minimum value measured by the sensor 13 during the at least one measurement or a mean of several measurements.

The value of the pressure jump Po may itself be a set value (in bar) comprised between 0.1 bar and 2 bar and preferably between 0.3 and 1 bar and more preferably still, between 0.4 and 0.6 bar. For example, for preference, the value of the pressure jump Po and the duration of the timing step are adjustable as a function of the characteristics of the filling device (type of pump, type of circuit, type of tank, etc.). For preference, the value of the pressure jump is a function of the value of the first reference instantaneous pressure PT3ref.

This pressure jump Po is defined as a function of the characteristics of the filling device. Thus, for example if, after the timing step A, the device has stabilized and the first pressure PT3 downstream of the variable-opening valve 12 reaches 9.5 bar and the pressure jump is defined at 0.5 bar, then $$PT3\text{ref}=9.5\text{ bar}$$

and $$P\text{max}=PT3\text{ref}+Po=9.5+0.5=10\text{ bar}.$$

Thus, in the continuation of the filling, if the first pressure PT3 measured by the first sensor 13 continuously reaches or exceeds this high threshold Pmax of 10 bar, the device automatically interrupts the filling.

Of course, the invention is not restricted to the example described hereinabove.

Thus, in place of (or in addition to) controlling the first instantaneous pressure PT3 downstream of the variable-opening valve 12, the device may control a mean mPT3ref of the maximum first instantaneous pressures PT3ref measured by the sensor 13. What that means to say is that the device calculates a mean mPT3ref of the maximum first instantaneous pressures PT3 measured. In that case, the high threshold Pmax is then defined by the sum on the one hand of the mean of the maximum first instantaneous pressures (mPT3ref) and, on the other hand, of a determined pressure jump (Po): Pmax=mPT3ref+Po.

Thus, at the end of the timing step A, if the first instantaneous pressure PT3 and/or a mean exceeds this high threshold, filling is interrupted.

The mean of the first instantaneous pressure mPT3 is, for example, the mean of several instantaneous pressures PT3 measured successively over a determined time interval. For example, the mean of several instantaneous pressures PT3 measured successively over an interval of a duration of, for example, between 0.1 and 10 seconds and preferably between 0.25 second and 1 second.

Of course, overpressure control may use other parameters derived from the first measured pressure PT3.

According to one advantageous specific, for preference during filling if, subsequently, the first measured pressure PT3 (or, as the case may be, the mean of the first pressure mPT3) were to drop below the reference value PT3ref adopted (or, as the case may be, mPT3ref), then this new reference value PT3refb replaces the previous value (cf. steps 105 and 106, FIG. 10). In this way, a new updated high threshold Pmax is recalculated Pmax=PT3refb+Po. This new high threshold which is lower in comparison with the previous high threshold thus adapts to a drop in the first pressure PT3 during filling, caused notably by the thermodynamic conditions of the filling. If not, namely if the first pressure PT3 does not decreased ("N" reference 105 in FIG. 10), the high threshold Pmax is unchanged.

What that means to say is that the first reference measured pressure PT3ref adopted is the most recently measured minimum value.

This reduction in the high threshold Pmax may be updated as often as necessary.

This calculating of the high threshold Pmax, the monitoring of whether or not the high threshold Pmax is exceeded and the stopping of the filling if required may be performed automatically by the electronic logic 16. As a non-preferred alternative it is possible to conceive of the operator being alerted to the exceeding of the high threshold Pmax and then having the task of stopping the filling.

For the sake of safety, if the signal from the first pressure sensor 13 is unavailable, the electronic logic 16 preferably commands the automatic stopping of the filling.

Figure 3:
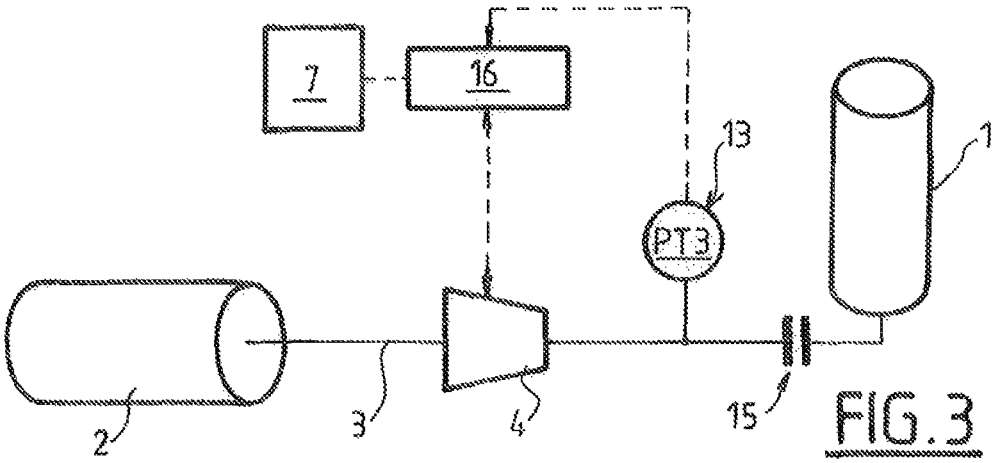
FIGS. 3 to 8 depict simplified and partial schematic views respectively illustrating six other possible embodiments of the structure and operation of a filling device according to the invention.

FIGS. 3 to 8 in a simplified manner illustrate some embodiments of the filling device. Elements identical to those described hereinabove are denoted by the same numerical references. In particular, FIG. 3 depicts the electronic logic 16 connected with the first pressure sensor 13 and the pump 4. The electronic logic 16 is also where appropriate connected to a display member 7 such as a man/machine interface in order to signal all or some of the state of operation of the device during filling.

In order to interrupt filling, according to one possible feature, the operation of the pump 4 may be interrupted. What that means to say is that the setpoint to which the pump 4 is controlled is brought down to a minimum and/or the motor of the pump 4 is switched from an on state to an off state and/or a pump member 4 driven by a motor is uncoupled from the motor of the pump 4 (made to "free-wheel"). Where appropriate, control of the pump 4 is achieved via a speed converter (which for the sake of simplicity has not been depicted). In the absence of a pump 4, filling may be interrupted by closing the variable-opening valve 12.

Figure 4:
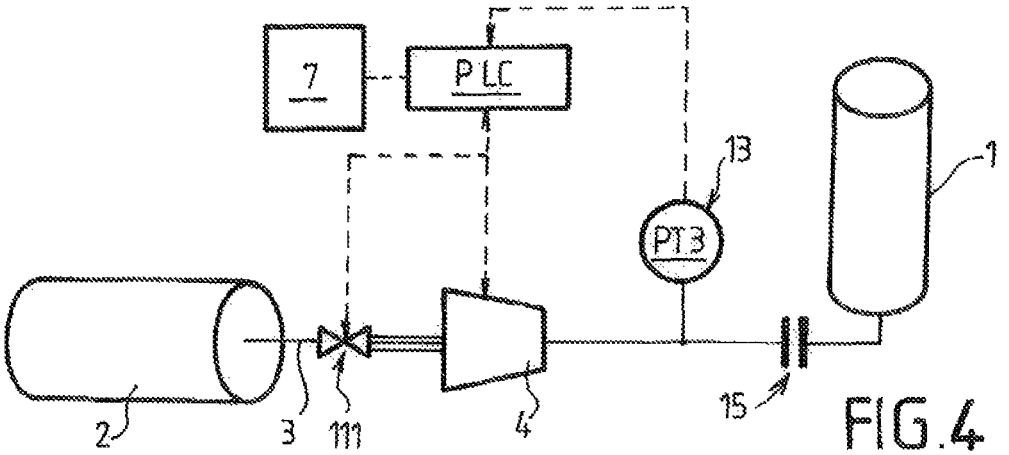

According to one other possible (alternative or cumulative) feature, filling can be stopped by reducing or eliminating the circulation of liquid along the filling pipe 3 upstream of the pump 4. As illustrated in FIG. 4, that can be achieved by closing a valve 111 of the filling pipe (for example the first valve 111 or the second valve 112 in FIG. 2). This measure, used in addition to the switching off of the pump 4 makes it possible to increase the effectiveness of the stopping of the filling notably by reducing the inertia effect of the system and notably the inertia of the pump 4. This is because even after the pump 4 has been switched off it may continue to supply liquid for a certain time. This specific feature also makes it possible to reduce any effects of a vaporization of cryogenic liquid present in the circuit. Several liters of liquid which are present in the circuit can thus be stopped upstream. In this way, the stopping of the filling is more rapid and more effective at avoiding an overpressure in the tank 1.

Figure 5:
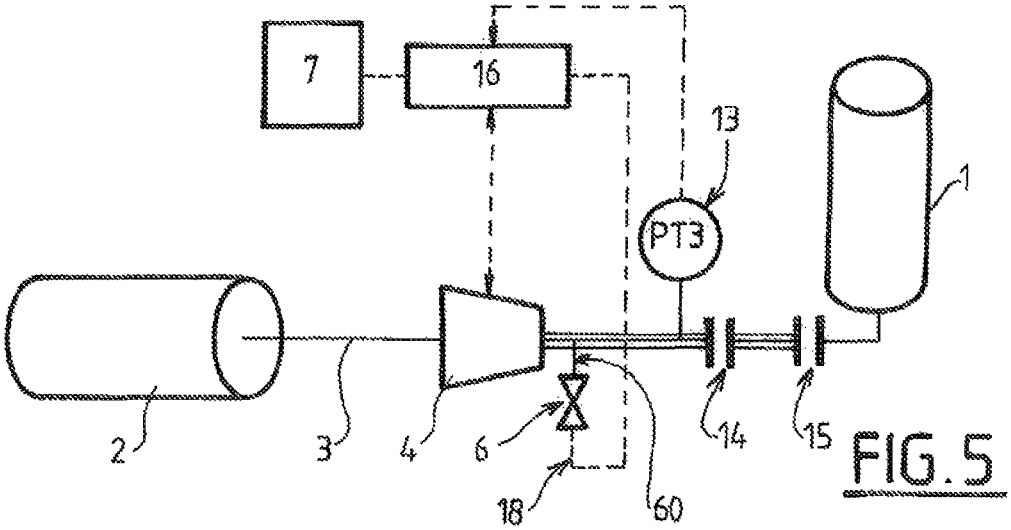

According to another possible (alternative or cumulative) feature, the stopping of the filling may be achieved by purging at least part of the filling pipe 3 situated downstream of the pump 4 to a discharge zone 18 distinct from the tank 1. As illustrated in FIG. 5 (and in FIG. 2), the device may for this purpose comprise, downstream of the pump 4, a purge pipe 60 fitted with at least one valve 6 controlled by the electronic logic 16 allowing liquid to be discharged to a discharge zone 18.

This feature thus allows at least the cryogenic fluid in the filling pipe 3 to be emptied into the atmosphere.

For safety reasons, this operation of purging downstream of the pump 4 is preferably performed for a limited purge duration of for example between two and sixty seconds and preferably between five and thirty seconds. The purge duration may be adapted to suit the characteristics of the purge valve (typically the coefficient of discharge Cv of the valve) and those of the piping to be purged (typically the length and the diameter). This notably makes it possible to limit the risks of hypoxia of the operators according to the nature of the gas released. This purge thus allows notably the downstream portion 30 of the filling pipe 3, notably in the flexible part, to be at least partially emptied.

Figure 6:
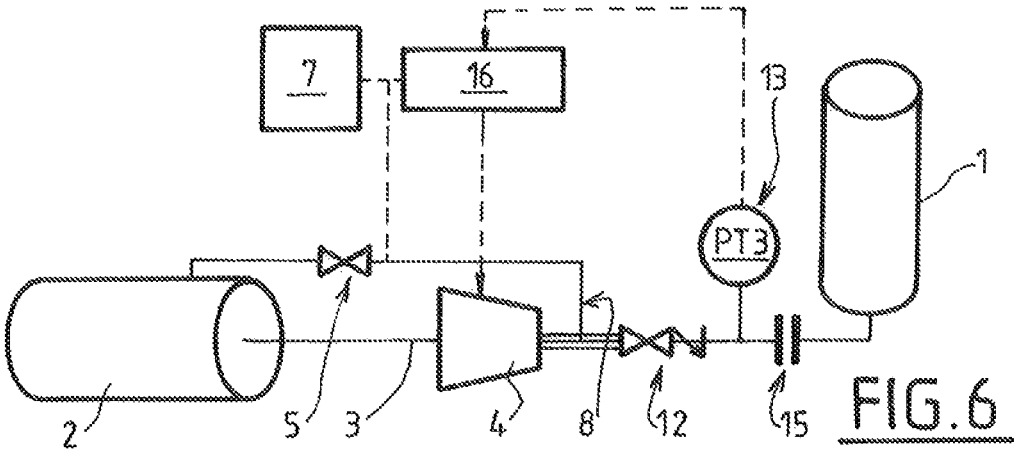

According to another possible (alternative or cumulative) feature, the stopping of the filling can be achieved by actuating a bypass that returns the liquid downstream of the pump 4 to the reservoir 2. As illustrated in FIG. 6, that can be achieved by opening the controlled bypass valve 55 of the bypass pipe 8.

This solution also increases the effectiveness and rapidity with which filling is stopped and avoids discharging a dangerous fluid around the reservoir 2.

As illustrated in FIG. 6, if the variable-opening valve 12 is of the type that prevents fluid from returning in the upstream direction, this returning of fluid to the reservoir 2 does not allow the fraction of fluid present downstream of this valve 12 to be discharged. However, this feature nonetheless makes it possible to improve the halting of the rise in pressure in the tank 1.

For preference, this opening of the bypass valve 5 of the bypass pipe 8 is preferably performed for a limited duration, for example of between two and sixty seconds and preferably between two and thirty seconds. In this way, the device avoids any risk of cavitation of the pump 4 and any risk of fluid from the tank 1 returning to the reservoir 2 if the variable-opening valve 12 is leaky.

For preference, after an interruption of the filling, the electronic logic 16 or the pump 4 itself prevents the pump 4 from restarting until a determined period of time preferably of between one second and fifteen minutes has elapsed.

While being of a simple and inexpensive structure, the device described hereinabove thus allows an abnormally high pressure in the tank 1 during the course of filling to be detected sufficiently quickly but not spuriously. The device also makes it possible to limit this abnormally high pressure by effectively stopping the filling in order to prevent the tank 1 from bursting.

One first possible and optional example of the stabilizing of the operating conditions of the pump 4 when it starts (namely before the filling is controlled below the high threshold Pmax as described hereinabove) will now be described.

Figure 11:
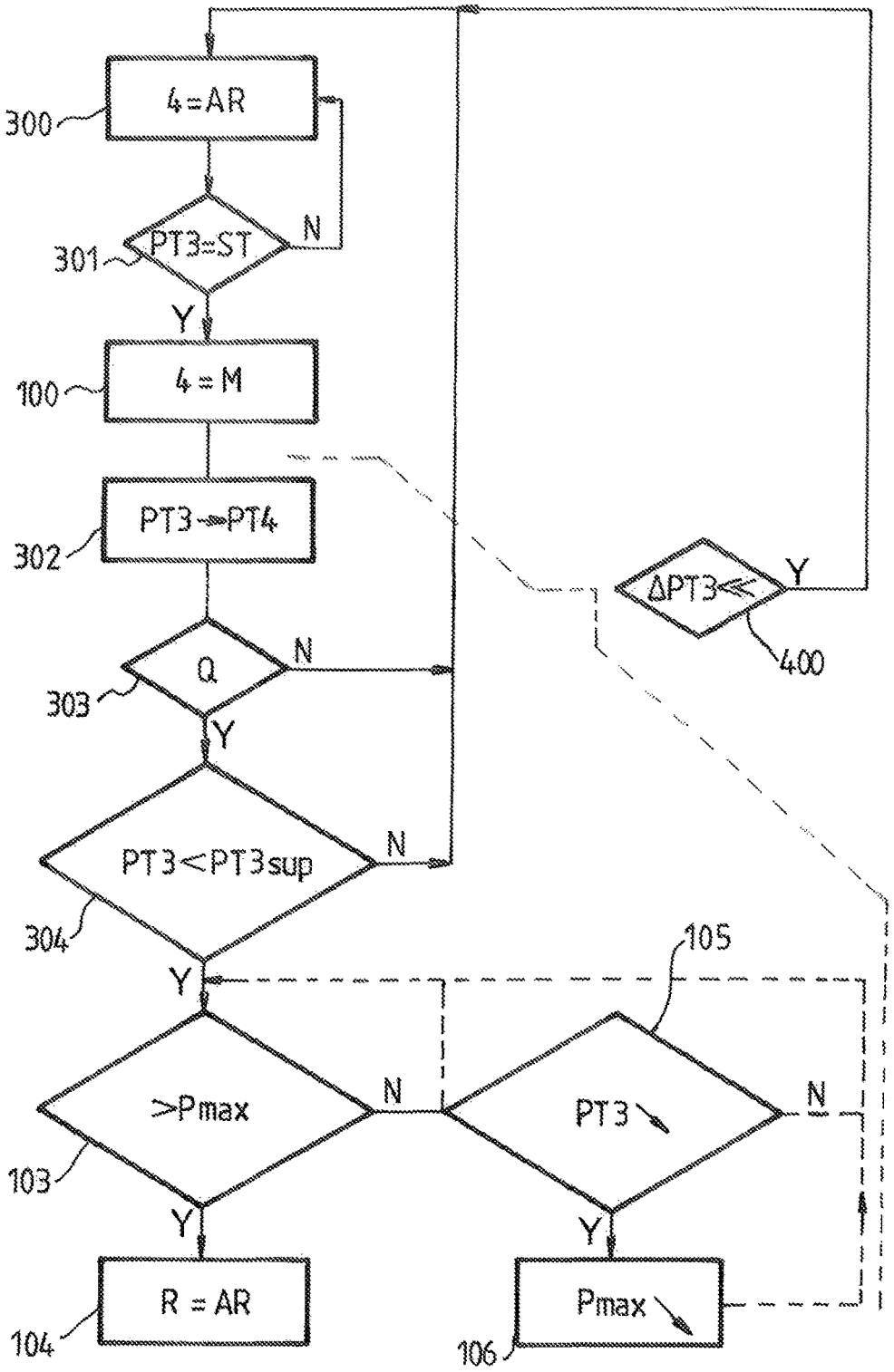
FIG. 11 illustrates a second example of a succession of steps performable during a filling according to one embodiment of the invention.

As indeed illustrated in FIG. 11, before the pump 4 starts M (the pump is switched off ("4=AR", reference 300, FIG. 11)), the device may make a check 301 on the stability ST of the first pressure PT3 in the filling pipe 3 (reference 301, FIG. 11). This first pressure PT3 is the pressure measured while the filling pipe is communicating with the inside of the tank 1. What that means to say is that this first measured pressure PT3 therefore mimics the pressure in the tank 1 that is to be filled (opening of the valves of the tank 1 downstream of the first pressure sensor 13).

For preference, the pump 4 cannot be switched on until this stability check (PT3=ST, step 301, FIG. 11) returns a positive "Y".

For example, this check on the stability of the first pressure PT3 is positive if at least one of the following conditions is satisfied:

(i) the first instantaneous pressure (PT3) in the pipe (3) is above a determined pressure of, for example, between 15 and 25 bar, (ii) the variation in the first instantaneous pressure (PT3) during at least a determined interval of time is below a determined level of variation corresponding for example to a variation, in absolute terms, of between 0.005 and 0.020 bar per second, and preferably 0.01 bar per second.

Optionally, another possible cumulative condition could be for the first measured pressure PT3 to be above atmospheric pressure.

Having the first condition (i) above satisfied indicates that the tank 1 to be filled is of the high-pressure type and therefore that it accepts high pressures.

The satisfying of the second condition (ii) above can be measured in various ways. For example, the value of the first pressure PT3 can be recorded over several successive intervals of ten seconds, for example five intervals of ten seconds each. Within each ten-second time interval, the value of the first pressure PT3 must not diverge by more than 0.1 bar. For preference, the five ten-second intervals partially overlap. For example, the five ten-second intervals begin each in their turn at one-second intervals. As an alternative, a mean of this pressure may be observed. The definition of the intervals is dependent in particular on the accuracy of the pressure sensor. This check is preferably performed after the filling pipe 3 has been swept, particularly if this pipe comprises a nonreturn valve 119.

This second condition (ii) is satisfied for example if, during five sequential time intervals (which overlap where appropriate), the first pressure PT3 within each interval does not diverge by more than 0.1 bar. If the first check 301 on the stability of the pressure is positive ("Y", FIG. 11), the pump 4 can be switched on ("4=M", step 100), otherwise it cannot be ("N", step 301 and return to the previous step 300).

The switching on of the pump 4 ("4=M", step 100) will determine a measuring of the pressure PT4 in the tank 1.

For example, at the moment of switching on M of the pump 4, the pressure PT4 in the tank 1 is determined only by measuring a first pressure (PT3→PT4) at the filling pipe 3 (step 302).

For example, this pressure PT4 in the tank 1 can be considered to be equal to the value of the first pressure PT3 measured at the pipe 3 at this moment PT3=PT4. Of course, a predetermined corrective coefficient (a multiplicative coefficient K and/or an additive coefficient C) can be used to determine the pressure PT4 in the tank 1 from the measured first pressure PT3. These coefficients can be obtained through testing, the inventors have determined that the dimensionless multiplicative corrective coefficient K may for example be between 0.8 and 1.2 (PT4=KPT3) and that the additive corrective coefficient C in bar may for example be between −2 bar and +2 bar (PT4=PT3+C).

The method may at the same time comprise a test on flow rate in order to determine that the flow rate supplied by the pump 4 is sufficient and that the pump 4 is not cavitating. Thus, the method may comprise a check that a minimal flow rate for example of 30 liters per minute is leaving the pump 4 for the tank 1 and/or that there is a minimum increase in pressure at the outlet of the pump 4 both at the pressure sensor 113 of the bypass pipe 8 and at the first pressure sensor 13, for example of 6 bar and 1 bar respectively (step 303, FIG. 11 and FIG. 9). If the outcome of this check is negative, the pump 4 is switched off automatically (N, return to step 300). If this condition is positive "Y" then the filling process can continue.

The method then comprises a step 304 of limiting the first instantaneous pressure PT3 to below a maximum pressure threshold PT3sup.

This step of limiting the first instantaneous pressure PT3 to below the maximum pressure threshold PT3sup is preferably performed for a finite determined limiting duration.

Limiting the first instantaneous pressure PT3 to below a maximum pressure threshold PT3sup is preferably achieved by the operator via manual regulation of the rate of flow of fluid transferred using the flow regulating member 12 and/or by regulating the pressure differential generated by the pump 4.

When the first instantaneous pressure PT3 remains above the maximum pressure threshold PT3sup at the end of the determined limiting duration, the filling is automatically interrupted AR ("N" return to step 300).

By contrast, when the first instantaneous pressure PT3 is below the maximum pressure threshold PT3sup at the end of the determined limiting duration, the filling is continued ("Y" then step 103 of keeping under a high threshold Pmax).

The determined limiting duration is, for example, between thirty and one hundred and eighty seconds and preferably equal to sixty seconds.

One additional safety condition may where appropriate be adopted in order to interrupt the filling if the first instantaneous pressure PT3 becomes too great during the limiting duration (excess value determined).

The limiting duration may be variable, notably according to the flow rate delivered to the store. If the flow rate is high, the duration is shorter and vice versa.

For preference, during this step of limiting the first instantaneous pressure PT3, the method comprises a measurement of the quantity Q of fluid transferred from the reservoir 2 to the tank 1. When this transferred quantity of fluid Q exceeds a threshold quantity Qs before the end of the determined limiting duration, said initially-planned limiting duration is reduced, for example, a limiting duration of five seconds at most is granted in order to finish the limiting step 304.

The maximum pressure threshold PT3sup is defined as a function of the previously determined value of the pressure PT4 in the tank 1.

For example, when this determined value of the pressure PT4 in the tank 1 is less than or equal to a first determined level of between three and five bar, for example of three bar, the maximum pressure threshold PT3sup is preferably a predetermined set pressure value of between 5 and 9 bar and preferably of 7 bar.

For example, when the pressure PT4 determined in the tank 1 is between three and four bar, the maximum pressure threshold PT3sup in bar may be given by the following formula:

$$PT3\text{sup}=z\cdot PT4+PA$$

where z is a unitless set predetermined coefficient between zero and two and preferably equal to one, and where PA is a set increase in pressure in bar of between zero and eight bar and preferably of four.

Likewise, when the pressure PT4 determined in the tank 1 is between 4 and 8.1 bar, the maximum pressure threshold PT3sup in bar may be given by the following formula:

$$PT3\text{sup}=z\cdot PT4+PA$$

z being a unitless set predetermined coefficient of between 0.80 and 1 and preferably of 0.98, and where PA is a set increase in pressure in bar of between two and four bar and preferably of four bar.

When the pressure PT4 determined in the tank 1 is between 8.1 and 19.5 bar, the maximum pressure threshold PT3sup in bar may be given by the following formula $$PT3\text{sup}=z\cdot PT4+PA$$

where z is a unitless set predetermined coefficient of between 1.00 and 1.50 and preferably of 1.20, and where PA is a set increase in pressure in bar of between one and four bar and preferably of 2.5 bar.

When the pressure PT4 determined in the tank 1 is higher than 19.5 bar and the variation in the first pressure PT3 is less than a determined level of variation of between 0.005 and 0.020 bar per second and preferably less than 0.01 bar per second, the maximum pressure threshold PT3sup in bar is given by the following formula:

$$PT3\text{sup}=z\cdot PT4+PA$$

where z is a unitless set predetermined coefficient of between 0.50 and 1.00 and preferably of 0.80, and where PA is a set increase in pressure in bar of between seven and 12 bar and preferably of 9.3 bar.

By contrast, when the pressure PT4 determined in the tank 1 is higher than 19.5 bar and the variation in the first pressure PT3 is greater than the value described hereinabove, the maximum pressure threshold PT3sup in bar may be a determined set value of between 30 and 50 bar and preferably of 37 bar.

The inventors have demonstrated that this step of limiting the first pressure PT3 beforehand allows better subsequent detection of a dangerous overpressure during filling that requires filling to be stopped.

After a positive ("Y") limiting step 304, the method may continue by then comparing the first instantaneous pressure PT3 against the high threshold Pmax and by interrupting the filling if the high threshold Pmax is crossed as described hereinabove with reference to FIG. 10 (steps referenced 103, 104, 105 and 106 in particular).

The first reference pressure value PT3ref used to start with for calculating the first high threshold Pmax is, for example, the value of the first pressure PT3 measured at the end or at the culmination of a positive limiting step 304.

Alternatively, the first reference pressure value PT3ref used to start off with for calculating the first high threshold Pmax is, for example, the first pressure value PT3 measured in the pipe 3 in a time interval of between zero and 180 s seconds after a switching on of the pump 4.

Alternatively, this first reference pressure PT3ref is measured in a determined time interval of between zero and 180 s seconds after the starting of the actual transfer of a flow of liquid to the tank 1 (corresponding for example to step 303 in FIG. 11 during which the pump supplies a minimal flow rate to the tank 1 and/or a minimum increase in pressure at the pump outlet 4 and a the first pressure sensor 13 occurs). As previously, the first reference instantaneous pressure PT3ref is the value measured during the at least one pressure measurement or a mean of this at least one pressure measurement.

For preference, throughout the filling process (as soon as the pump 4 is switched on 100) and after the flow regulating member 12 has moved from its no-flow position into its flow position, if a drop in the first instantaneous pressure PT3 in the filling pipe 3 is detected at a rate of at least one bar per second, the pump 4 is automatically switched off (reference 400, FIG. 11).

This safety measure makes it possible to detect a fall in pressure which is synonymous with an abnormally belated opening of the valves of the tank 1. What that means to say is that if this drop in the first pressure PT3 occurs during the course of filling, that means that the tank 1 was beforehand isolated from the filling pipe 3 and that the measurements and calculations performed beforehand were erroneous, particularly the determining of the pressure PT4 in the tank.

A second possible and optional example of the stabilizing of the conditions of operation of the pump 4 as it starts (namely before the control of the filling described hereinabove notably in conjunction with FIG. 10) will now be described.

Figure 12:
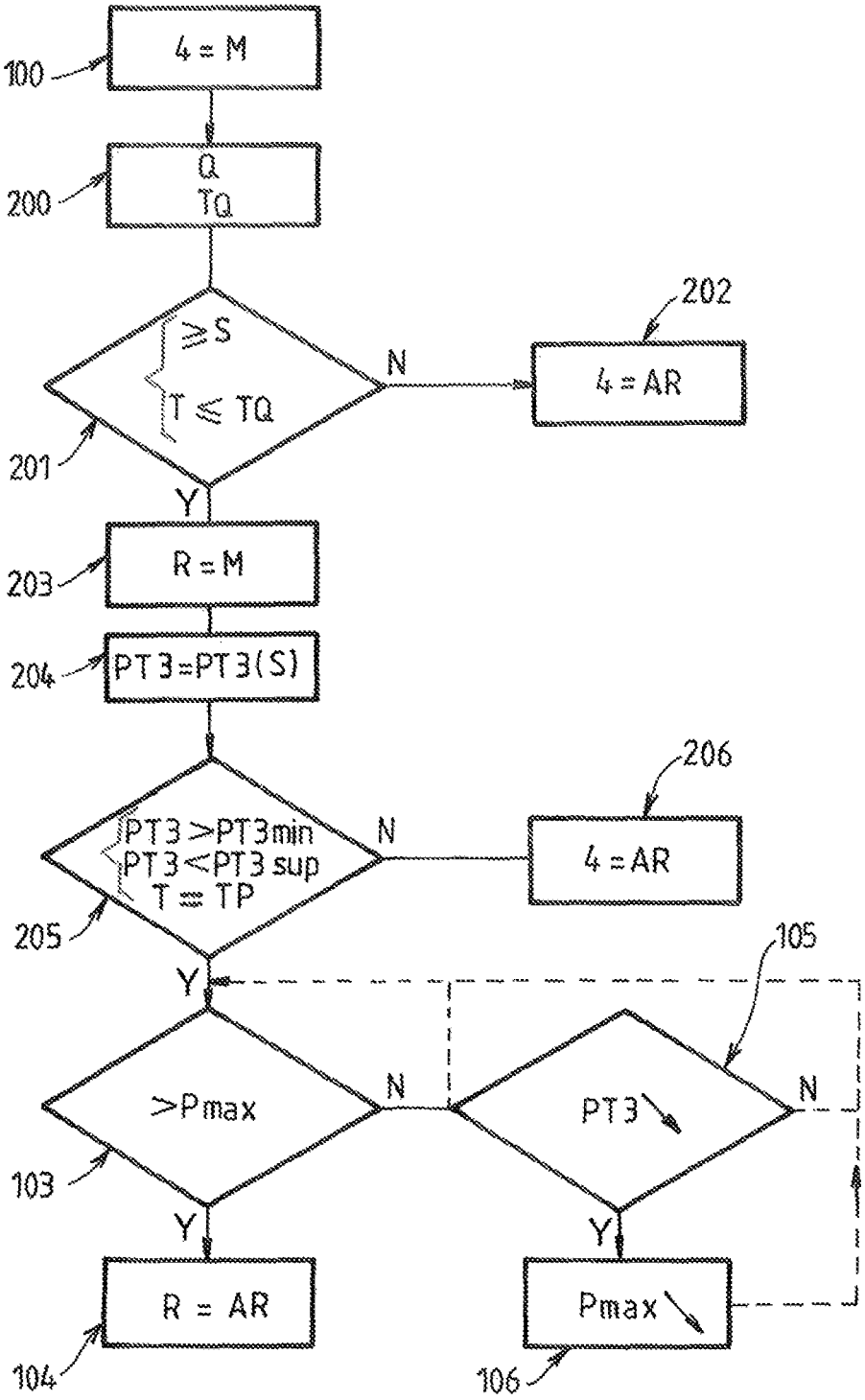
FIG. 12 illustrates a third example of a succession of steps performable during a filling according to one embodiment of the invention.

As illustrated in FIG. 12, the starting M of the pump 4 (reference 100) may comprise a precheck on the flow rate actually delivered by the pump 4 to the tank 1 for a determined flow rate precheck duration TQ (step 200 in FIG. 12). This flow rate precheck comprises a determining of actual transfer of liquid to the tank 1 by the pump 4 during this flow rate precheck duration TQ. Determining that liquid is actually being transferred to the tank 1 by the pump 4 may involve determining whether the operator (or the device if it is partially automated) is beginning the actual transfer of liquid to the tank 1. Indeed before starting the filling, the pump 4 may be cooled and stabilized for a determined interval of time during which the liquid pumped from the reservoir 2 is returned to the reservoir by the bypass pipe 8 (by opening for example the bypass valve 5 and keeping the variable-opening valve 12 closed).

What that means to say is that when the pump 4 is switched on at least some of the liquid delivered by the pump 4 may first of all be returned at least predominantly to the reservoir 2 via a return pipe 8. Then the liquid is progressively delivered predominantly to the tank 1, notably when the pump 4 reaches a stabilized operating regime.

According to one advantageous specific, electronic logic 16 is configured to compare the transfer of liquid to the tank 1 with a determined threshold S and, when the transfer of liquid to the tank 1 has not reached this threshold S during the flow rate precheck duration TQ, the electronic logic 16 interrupts AR the operation of the pump 4 (cf. references 201 and 202, FIG. 12). Such a switching off of the pump 4 signifies that the start is not satisfactory for continuing the process of beginning the filling.

Specifically, the inventors have noticed that this initial measure makes it possible to avoid operating conditions that detract from good subsequent filling and notably from future detection of an abnormal pressure that triggers the stopping of the filling as described hereinabove.

Figure 8:
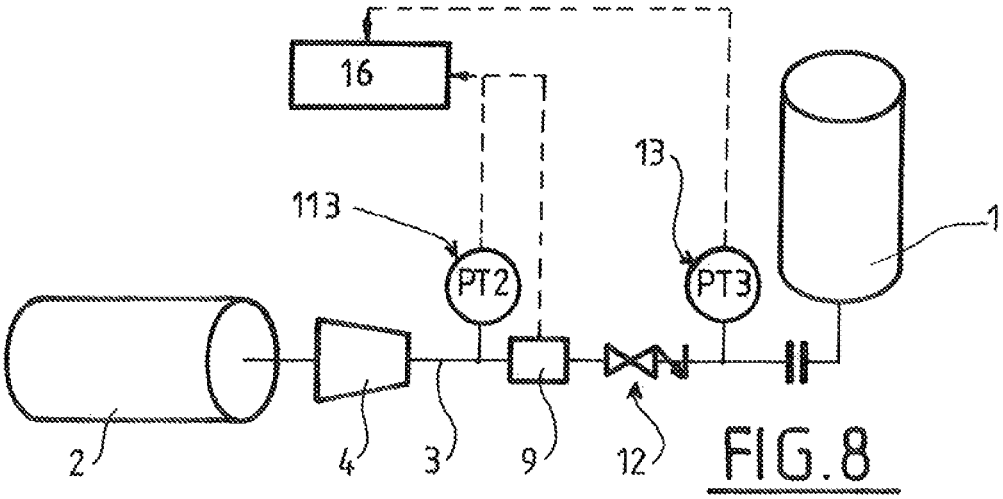

The determining of a transfer of liquid to the tank 1 may for example comprise a measurement 9 of the instantaneous flow rate Q of liquid in the filling pipe 3 downstream of the pump 4 and upstream of the tank 1 (cf. FIG. 8).

Figure 7:
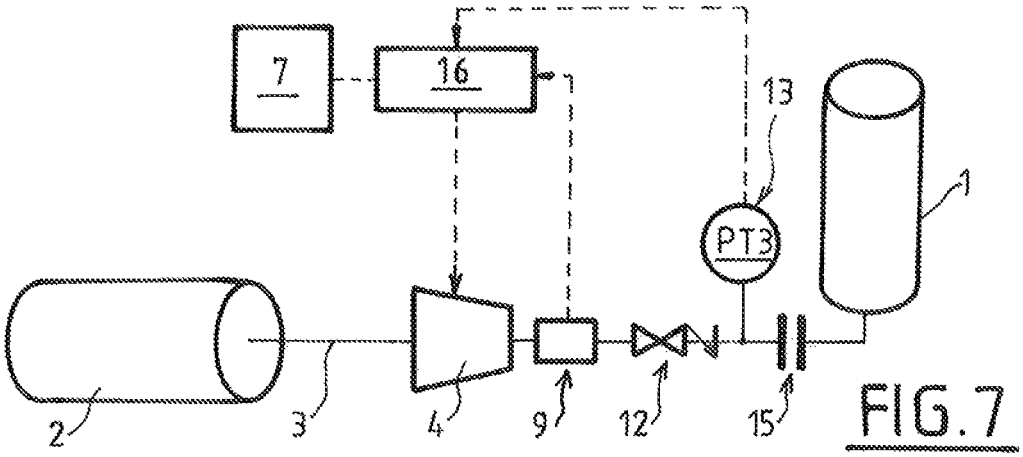

For that purpose, and as illustrated in FIGS. 7 and 8, the filling pipe may comprise a flow meter 9 connected to the electronic logic 16. Thus, the electronic logic 16 can compare the measured instantaneous liquid flow rate Q against a determined minimum flow rate threshold Qmin and, when the measured instantaneous liquid flow rate Q has not reached the minimum flow rate threshold Qmin during the determined flow rate precheck duration TQ, a step of interrupting AR the operation of the pump 4.

The determined minimum flow rate threshold Qmin can be chosen beforehand according to the technical characteristics of the filling device (type of pump, etc.). This minimum flow rate threshold Qmin is for example between one and fifty liters per minute and preferably between ten and forty liters per minute or between three and eight liters per minute, for example five liters per minute.

The determined flow rate precheck duration TQ may be between twenty and two hundred and forty seconds and preferably between thirty and a hundred and twenty seconds, for example ninety seconds.

Of course, alternatively or cumulatively, the transfer of liquid to the tank 1 can be determined in a different way.

For example, a transfer of liquid to the tank 1 may be determined in a way that involves measuring the first instantaneous pressure PT3 in the filling pipe 3 downstream of the pump 4 and upstream of the tank 1, notably downstream of the variable-opening valve 12, using the first pressure sensor 13 described hereinabove.

This instantaneous pressure PT3 may be compared with the predetermined reference level and, when this measurement of the first instantaneous pressure PT3 in the filling pipe 3 does not reach the reference level during the determined flow rate precheck duration TQ, the pipe 4 is switched off.

For preference though, a transfer of liquid to the tank 1 is determined by checking the changes in pressure or pressure differentials. For example, the device checks the instantaneous pressures PT3 and PT50 respectively at the filling pipe 3 downstream of the variable-opening valve 12 and at the return pipe 8 in real time.

To do that, the device may use the pressure PT50 sensor 29 upstream of the bypass valves 5, 55 (cf. FIG. 2).

For example, an increase in the first pressure PT3 above a determined threshold simultaneous with a decrease in the pressure PT50 determined in the bypass pipe 8 corresponds to sufficient actual transfer.

If this sufficient actual transfer is not achieved during the determined flow rate precheck duration TQ then the pump 4 is switched off.

When the transfer of liquid in the tank 1 reaches this threshold (determined flow rate or pressure or pressure differential) during the determined duration TQ, operation of the pump 4 is maintained and filling R becomes effective ("Y" and reference 203, FIG. 12).

In addition, for preference, the first instantaneous pressure PT3 in the filling pipe 3 is measured downstream of the pump 4 at the moment at which the transfer of liquid to the tank 1 reaches the determined threshold S (PT3(S), cf. reference 204, FIG. 12). This value may be stored by the electronic logic 16.

For preference also, the method then comprises an additional precheck on the first pressure PT3 in the filling pipe.

More specifically, the method may then comprise a step of prechecking the first pressure PT3 in the filling pipe 3 downstream of the variable-opening valve 12 for a determined pressure precheck duration TP.

Thus, for example, when the first pressure PT3 measured by the first sensor 13 in the filling pipe 3 downstream of the pump 4 exceeds a maximum pressure threshold PT3sup or is below a minimum pressure threshold PT3min during the determined pressure precheck duration TP, the operation of the pump 4 is interrupted AR (cf. references 205 and 206, FIG. 10).

This pressure precheck is preferably designed to ensure that the pressure regulated in the filling pipe 3 downstream of the pump 4 is maintained within a determined interval. The inventors have actually determined that such an action improves the filling and notably the potential later detection of an abnormal overpressure as described previously.

The maximum pressure threshold PT3sup in bar may be identical to that described in the example of FIG. 11. The determined value of the pressure PT3=PT4 in the tank 1 may be the value of the first pressure PT3 recorded for example at the moment when the transfer of liquid to the tank 1 reaches the determined threshold of the step 204 described hereinabove.

For preference, the minimum pressure threshold PT3min is a predetermined set value which may possibly be adjustable, for example between two bar and ten bar and preferably between four and ten bar, notably five bar.

The determined pressure precheck duration TP is, for example, between five and one hundred and eighty seconds and preferably between ten and thirty seconds, for example fifteen seconds.

When this measured first pressure PT3 remains below the maximum pressure threshold PT3sup and above the minimum pressure threshold PT3min for the determined pressure precheck duration TP, the operation of the pump 4 is maintained and the filling of the tank 1 is continued.

The method may then comprise a check on the filling as described hereinabove with reference notably to FIG. 10. Thus, FIG. 12 reproduces by way of example steps 103, 104, 105 and 106 of FIG. 9. For the sake of conciseness, this process will not be described a second time.

According to a preferred but nonlimiting advantageous specific feature, the predetermined high threshold Pmax used for interrupting filling where appropriate as mentioned hereinabove is calculated or defined at the end of the determined pressure precheck duration TP. What that means to say is that the measurement or measurements of the first pressure PT3 used to define the first reference pressure PT3ref (or a mean of these pressures mPT3ref) is performed at the end of the determined pressure precheck duration TP (assuming of course that the pump 4 has not been stopped).

What that means to say is that the timing A mentioned hereinabove may include the checks described with reference to FIG. 12.

These processes make it possible to regulate the pressure in the filling pipe 3 downstream of the pump 4 to values close to those of the pressure PT4 prevailing in the tank 1 and for optimum operation of the pump 4. In addition, the filling performed at these pressure levels allows any overpressures in the tank 1 that require filling to stop to be better detected at the filling pipe 3. Having these overpressures better detected notably means that the potential overpressure is detected more early on and more accurately in the tank 1 only. In particular, the process described with reference to FIG. 12 makes it possible to reduce the differential in pressure between, on the one hand, the filling pipe 3 downstream of the pump 4 and, on the other hand, the inside of the tank 1.

It will be understood that many additional changes in the details, materials, steps and arrangement of parts, which have been herein described in order to explain the nature of the invention, may be made by those skilled in the art within the principle and scope of the invention as expressed in the appended claims. Thus, the present invention is not intended to be limited to the specific embodiments in the examples given above.

The invention claimed is:

1. A method for filling a liquefied gas tank, from a filling device comprising a liquefied gas reservoir, the reservoir being fluidically connected to the tank via a filling pipe, the filling device comprising a pressure differential generating member for selectively transferring liquid from the reservoir to the tank, the pressure differential generating member being switchable to an on (M) state or an off (AR) state, the filling pipe comprising a liquid flow regulating member positioned downstream of the differential generating member, the flow regulating member being movable between a no-flow position in which the flow of liquid is interrupted and at least one flow position in which the flow of liquid is transferred to the tank at a determined flow rate, the method comprising a step of starting the filling, during which step the flow regulating member is moved from the no-flow position to a flow position and a continuous or periodic measurement of a first instantaneous pressure (PT3) in the filling pipe downstream of the flow regulating member, wherein, after a determined duration following the starting of the filling, the method comprises comparing the first instantaneous pressure (PT3) in the filling pipe, or a mean of this first instantaneous pressure (PT3), against a determined high threshold (Pmax) and, when the first instantaneous pressure (PT3) in the filling pipe exceeds the high threshold (Pmax), a step of interrupting (AR) the filling (R) and in that, during or after the starting of the filling, the method comprises determining a first reference instantaneous pressure (PT3ref) or a mean of reference instantaneous pressures (mPT3ref) in the filling pipe (3), and in that the high threshold (Pmax) is defined by the sum of the first reference instantaneous pressure (PT3ref) or of the mean of reference instantaneous pressures (mPT3ref) and of a determined pressure jump (Po) (Pmax=PT3ref+Po), and in that the determining of the first reference instantaneous pressure (PT3ref) or the mean reference instantaneous pressure (mPT3ref) in the filling pipe is performed at least a first time via a measurement of the first instantaneous pressure (PT3) in the pipe (3) or of a mean (mPT3) of several measurements of this first instantaneous pressure (PT3) in a determined time interval of between zero and 180 seconds around at least one of the following events: the switching of the differential generating member from the off state (AR) to the on state (M), the start of a transfer of fluid from the reservoir to the tank, the step of determining the first reference instantaneous pressure (PT3ref) in the filling pipe comprising at least one measurement of the first instantaneous pressure (PT3) in the pipe in a time interval of between zero and 180 seconds after a switching on (M) of the pressure differential generating member or in a determined time interval of between zero and 180 seconds after the starting of actual transfer of a flow of liquid to the tank, the first reference instantaneous pressure (PT3ref) being the value measured during the at least one pressure measurement or a mean of this at least one pressure measurement.

2. The method as claimed in claim 1, wherein, after the first reference instantaneous pressure (PT3ref) or the mean reference instantaneous pressure (mPT3ref) has been determined and, during filling, the first instantaneous pressure (PT3) in the pipe is measured regularly and, if the first instantaneous pressure (PT3) measured in the pipe or the mean thereof drops below the first reference instantaneous pressure (PT3ref) previously adopted or the reference mean (mPT3ref) thereof, a new reference instantaneous pressure (PT3refb) or a new reference mean (mPT3*b*) is determined and used to define a new high threshold (Pmax=PT3refb+Po, or Pmax=mPT3refb+Po).

3. The method as claimed in claim 2, wherein a new high threshold (Pmax) is calculated upon each measured drop of the first instantaneous pressure (PT3) below the current first reference instantaneous pressure (PT3ref) previously adopted upon each measured drop in the reference mean (mPT3) below the current reference mean (mPT3ref) previously adopted.

4. The method as claimed in claim 1, wherein the step of interrupting the filling comprises at least one of the following: reducing or stopping the circulation of liquid in the filling pipe, stopping the pressure differential generating member, a purging of at least part of the filling pipe to a discharge zone distinct from the tank, activation of a bypass returning the liquid circulating in the filling pipe to the reservoir, the emission of a visual and/or audible alarm.

5. The method as claimed in claim 1, wherein the pressure differential generating member comprises at least one of the following: a pump, a vaporizer for selectively pressurizing the reservoir, is selectively switchable between an on (M) state and an off (AR) state, the method comprising a switching on of the pressure differential generating member and in that the pressure differential generating member is switched to its off state (AR) automatically in response to at least one of the following situations:

- the variation in the first instantaneous pressure (PT3) in the filling pipe during a determined time (T) before a flow of liquid is actually transferred to the tank is greater than a determined variation (V) (ΔPT3>V),
- a determined variation in flow rate (Q) and/or a determined variation in a second instantaneous pressure (PT2) in the pipe downstream of the pressure differential generating member is detected while the pressure differential generating member is not in the switched-on state (M),
- after a determined time following the switching on of the pressure differential generating member, the variation in the first instantaneous pressure (PT3) in the pipe and/or the variation in flow rate (Q) remains below a determined level,
- after a determined time following the switching on of the pressure differential generating member or the start of transfer of a flow to the tank or even after a determined quantity of fluid has been transferred to the tank, the first instantaneous pressure (PT3) in the pipe remains above a determined high level,
- after a determined time following the switching on of the pressure differential generating member or the start of transfer of a flow to the tank, or even after a determined quantity of fluid has been transferred to the tank, the differential (PT2−PT3) between, on the one hand, a second instantaneous pressure (PT2) measured at the outlet of the pressure differential generating member, upstream of the flow regulating member and, on the other hand, the first instantaneous pressure (PT3) measured in the pipe downstream of the flow regulating member is less than a minimum differential between 0.5 bar and 2 bar,
- a fall in the first pressure (PT3) of at least one bar per second is measured.

6. The method as claimed in claim 1, further comprising a switching on (M) of the pressure differential generating member, the step of interrupting (AR) the filling (R) when the first instantaneous pressure (PT3) or, as the case may be, the mean instantaneous pressure (mPT3) in the filling pipe exceeds the high threshold (Pmax) being performed only at the end of a timing step (A) notably designed to allow the conditions in which liquid is transferred to the tank to stabilize, the timing step (A) beginning with the switching on of the pressure differential generating member or with the transition of the regulating member to the flow position and having a determined finite duration.

7. The method as claimed in claim 1, wherein during or before the determined duration following the starting of the transfer of a flow of liquid to the tank, any potential variations in the first instantaneous pressure (PT3) measured in the filling pipe or variations in the mean of these measurements above the high threshold (Pmax) do not trigger the stopping of the filling.

8. The method as claimed in claim 1, wherein after the pressure differential generating member has been switched on (M) and the flow regulating member has been moved from its no-flow position into its flow position, if a drop in the first instantaneous pressure (PT3) in the filling pipe at a rate of at least one bar per second is detected, the operation of the pressure differential generating member is automatically switched off (AR).

9. The method as claimed in claim 1, wherein, at the start of filling the method comprises measuring the reference value of the first instantaneous pressure (PT3ref) or of a reference mean of the instantaneous pressure (mPT3ref) in the filling pipe, in that when the reference instantaneous pressure (PT3ref) or the reference mean instantaneous pressure (mPT3ref) is higher than a predetermined low value and lower than a predetermined high value, the high threshold (Pmax) is less than or equal to twice the value of the first reference instantaneous pressure (PT3ref) or the mean reference instantaneous pressure (mPT3ref) (Pmax≤2PT3ref).

10. The method as claimed in claim 1, wherein the pressure differential generating member comprises at least one of the following: a pump, a heater, a vaporizer.

11. The method as claimed in claim 1, wherein the start of filling corresponds to at least one of the following: the switching on of the pressure differential generating member, the start of actual transfer of fluid from the reservoir to the tank.

12. The method as claimed in claim 1, wherein the value of the pressure jump is an adjustable or non-adjustable set value comprised between 0.1 bar and 2 bar.

13. The method as claimed in claim 1, wherein when the first reference instantaneous pressure (PT3ref) is less than or equal to a value of between 6 and 9 bar, the pressure jump is between 0.1 and 0.9.

14. A device for filling a liquefied gas tank, comprising a cryogenic liquid reservoir, the reservoir being selectively fluidically connected to the tank via a filling pipe having an upstream first end connected to the reservoir and a downstream second end that can be selectively coupled to a tank, the device comprising a pressure differential generating member for transferring liquid from the reservoir to the tank via a filling pipe, a regulating member for regulating the flow of liquid in the filling pipe, the flow regulating member being movable between a no-flow position in which the flow of liquid is interrupted and at least one flow position in which the flow of liquid is transferred to the tank at a determined respective flow rate, the device further comprising a first pressure sensor positioned on the filling pipe downstream of the flow regulating member, said first sensor continuously or periodically measuring a first instantaneous pressure (PT3) downstream of the pressure differential generating member, the device comprising electronic logic connected to the pressure differential generating member, to the first pressure sensor and to at least one member for selectively limiting or interrupting the filling, the electronic logic being configured in order to make, during the filling, after a determined time following the start of transfer of a flow of liquid to the tank, a comparison between the continuously or periodically measured first instantaneous pressure (PT3) or a mean of this first instantaneous pressure (PT3) and a determined high threshold (Pmax) and, when the first instantaneous pressure (PT3) or, as the case may be, the mean of the first instantaneous pressures (PT3) in the filling pipe exceeds the high threshold (Pmax), to interrupt (AR) the filling (R) via the at least one limiting or interrupting member, and in that the electronic logic is configured to determine a first reference instantaneous pressure (PT3ref) or a reference mean instantaneous pressure (mPT3ref) in the filling pipe during or after the starting of the filling, the high threshold (Pmax) being defined by the sum on the one hand of the first reference instantaneous pressure (PT3ref) or, as the case may be, of the mean of several reference instantaneous pressures (mPT3ref) measured, and a determined pressure jump (Po) (Pmax=PT3ref+Po or, Pmax=mPT3ref+Po), the first reference instantaneous pressure (PT3ref) or the reference mean instantaneous pressure (mPT3ref) in the filling pipe being determined at least a first time via a measurement of the first instantaneous pressure (PT3) in the pipe or of a mean (mPT3) of measurements of this first instantaneous pressure (PT3) in a determined time interval of between zero and 180 seconds about at least one of the following events: the switching of the differential generating member from the off state (AR) to the on state (M), the start of transfer of fluid from the reservoir to the tank, the determining of the first reference instantaneous pressure (PT3ref) in the filling pipe comprising at least one measurement of the first instantaneous pressure (PT3) in the pipe in a time interval of between zero and 180 seconds after a switching on (M) of the pressure differential generating member or in a determined time interval of between zero and 180 seconds after the starting of actual transfer of a flow of liquid to the tank, the first reference instantaneous pressure (PT3ref) being the value measured during the at least one pressure measurement or a mean of this at least one pressure measurement.

15. The device as claimed in claim 14, wherein the at least one limiting or interrupting member comprises at least one of the following:

- a switch or actuator commanding the switching off of the pressure differential generating member,
- a purge pipe provided with a valve that is controlled and connected to the electronic logic, the purge pipe comprising a first end coupled to the filling pipe and a second end opening into a discharge zone distinct from the tank,
- a bypass pipe provided with a valve that is controlled and connected to the electronic logic, the bypass pipe comprising a first end coupled to the filling pipe and a second end opening into the reservoir,
- a controlled isolation valve connected to the electronic logic.

* * * * *